US007329622B1

(12) United States Patent
Ulli

(10) Patent No.: US 7,329,622 B1
(45) Date of Patent: Feb. 12, 2008

(54) METHOD AND DEVICE FOR PARTIALLY APPLYING A SURFACE COATING AND BREATHABLE FILM WITH SUCH A PARTIAL SURFACE COATING

(75) Inventor: Andreas Ulli, Berg (CH)

(73) Assignee: Solipat AG, Zug (CH)

( * ) Notice: Subject to any disclaimer, the term of this patent is extended or adjusted under 35 U.S.C. 154(b) by 961 days.

(21) Appl. No.: 09/926,694

(22) PCT Filed: May 23, 2000

(86) PCT No.: PCT/CH00/00289

§ 371 (c)(1),
(2), (4) Date: Feb. 28, 2002

(87) PCT Pub. No.: WO00/74863

PCT Pub. Date: Dec. 14, 2000

(30) Foreign Application Priority Data

Jun. 4, 1999 (EP) ..... 99110708
Jun. 10, 1999 (EP) ..... 99201857

(51) Int. Cl.
*B05C 1/10* (2006.01)
*B05C 9/04* (2006.01)

(52) U.S. Cl. ..... 442/149; 442/150; 428/343; 428/354; 428/173; 428/200; 427/208

(58) Field of Classification Search ..... 428/343, 428/354, 178, 200, 173, 304.4; 427/208; 442/149, 150
See application file for complete search history.

(56) References Cited

U.S. PATENT DOCUMENTS 4,587,152 A * 5/1986 Gleichenhagen et al. ... 428/195
4,732,800 A * 3/1988 Groshens ..... 428/196
5,827,579 A * 10/1998 Groshens ..... 427/552

FOREIGN PATENT DOCUMENTS

EP 0 392 625 * 10/1990

OTHER PUBLICATIONS

Japanese Pat Abstract 58 040172, Mar. 1983.*

* cited by examiner

*Primary Examiner*—Daniel Zirker
(74) *Attorney, Agent, or Firm*—Shoemaker and Mattere

(57) ABSTRACT

A vapor permeable, water impermeable film is coating partially with an adhesive surface coating. The partial adhesive coating is deposited on both surfaces of the film and coated areas on one surface of the film are at least partially in line with the coated areas of the second surface. A three ply laminate sheet is manufactured having a middle layer consisting of a vapor permeable water impermeable films having partial surface coating with an adhesive material on both surfaces.

5 Claims, 5 Drawing Sheets

Figure 1:
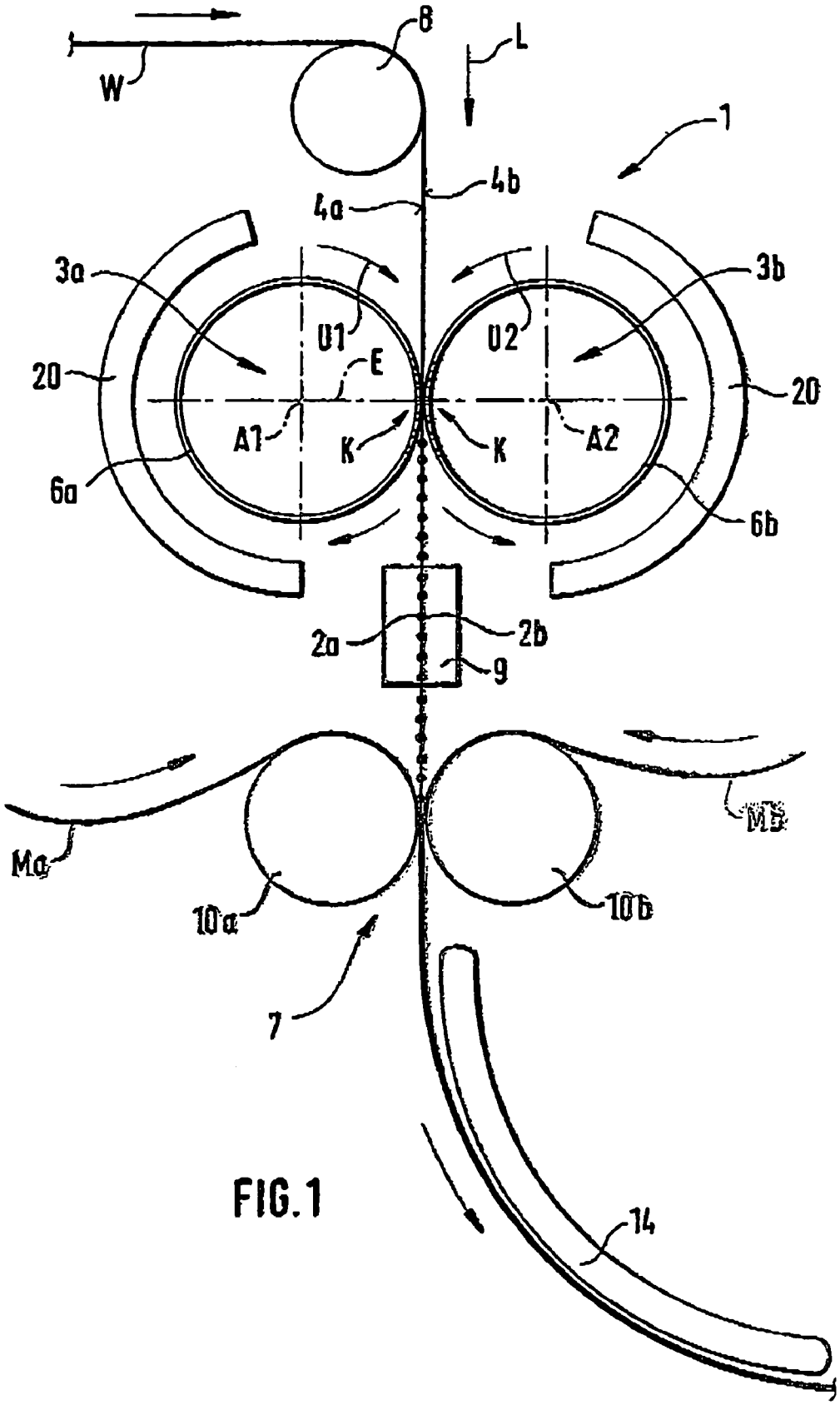

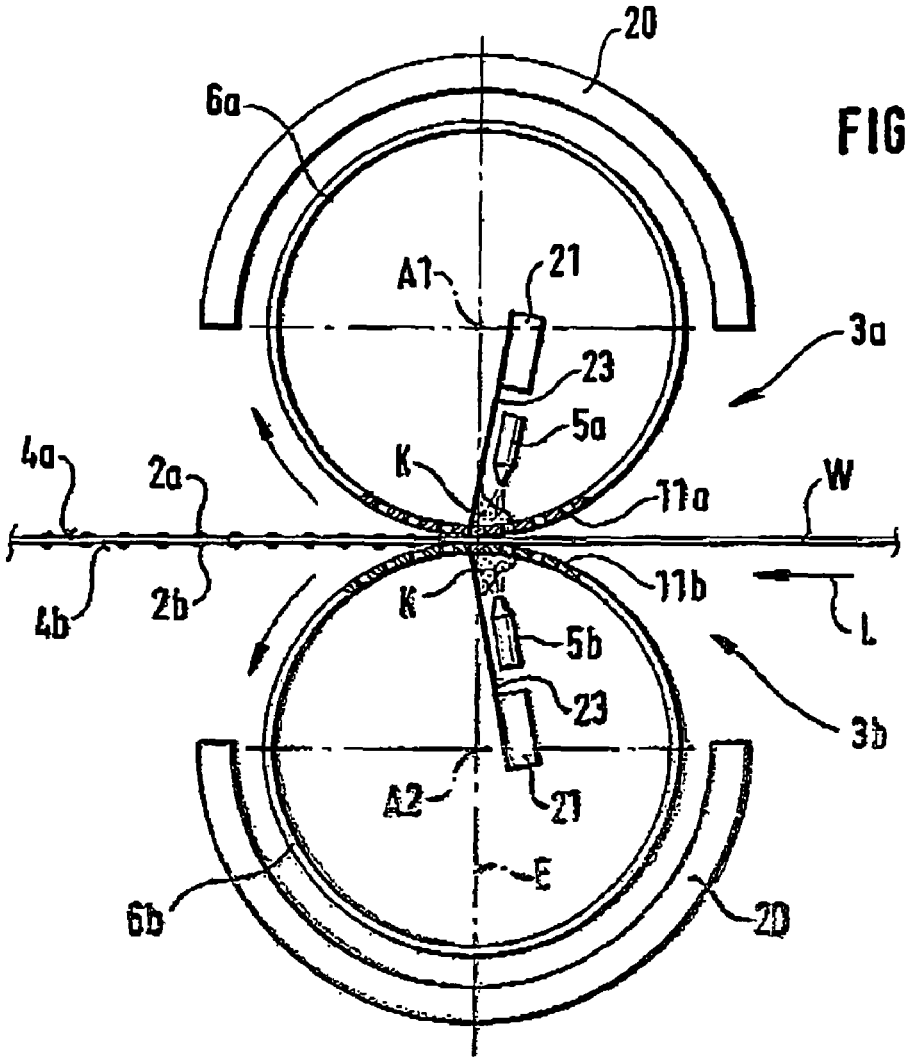
FIG. 2
FIG. 3a
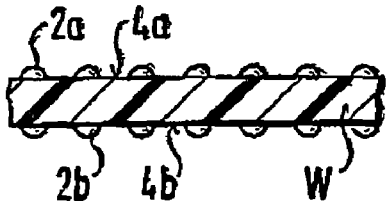
FIG. 3b
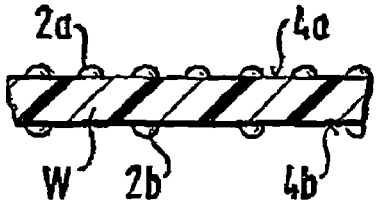
FIG. 3c
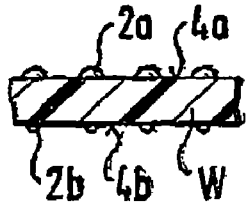

METHOD AND DEVICE FOR PARTIALLY APPLYING A SURFACE COATING AND BREATHABLE FILM WITH SUCH A PARTIAL SURFACE COATING

The invention relates to a device and a method for depositing partial surface coatings onto a breathing-active, waterproof film and to a film with such a surface coating with the features of the preamble of the independent patent claims.

For manufacturing multi-layered sheet formations it is known on a substrate to deposit a dot-like surface coating of an adhesive. Subsequently the substrate is laminated with another film. The film is via the adhesive points connected to the substrate. Such sheet formations are for example applied as breathing-active the textiles for clothing.

From CH 648 497 and CH 663 310 there are known methods and devices with which the partial surface coating is deposited with the screen printing method with the help of a rotating screening drum. With this known method and with this known device it is possible to manufacture two-layered sheet formations laminated on one side.

It is desirable not only to manufacture two-layered but also three-layered sheet formations. Thus for example with pieces of clothing it is advantageous when a middle, breathing-active film may be laminated on both sides (i.e. with an outer layer and with a lining).

It is therefore the object of the present invention to provided a method and a device for depositing partial surface coatings on both sides of a film so that the film may be laminated on both sides. A further object of the invention lies in providing a film with a partial surface coating on both sides. A further object lies in providing a device for producing three-layered sheet material with an intermediate, breathing active layer in providing such material.

The surface coating on both sides should not compromise the breathing activity of the film. Furthermore the textile feel of the film in comparison with films laminated on one side should not be worsened.

According to the invention these objects are achieved with a device and with a method as well as with a film with the features and with a three-layered sheet material of the characterising part of the independent patent claims.

The device according to the invention for depositing a partial surface coating is based on the screen printing principle shown in CH 648 497 and CH 663 310. The contents of these publications are herewith expressly taken up into the contents of the present application. The device comprises at least one depositing device for the direct or indirect depositing of a flowable plastic mass onto the one side of the film or onto a substrate. The first depositing device comprises preferably at least one depositing nozzle and a first movable screen. The movable screen is arranged between the depositing nozzle and the film or between the depositing nozzle and the substrate. The first screen is synchronously movable with the film or with the substrate.

With the indirect depositing the flowable plastic mass is first deposited onto a substrate, for example in the form of an endless tape or in the form of a cylinder and then transferred from the substrate onto the film. Depositing nozzle in the context of the present application is to be understood as any device for depositing the plastic mass.

For coating the other surface of the film the device according to the invention comprises at least one second depositing device arranged on the other side of the film. The second depositing device serves for the direct or indirect depositing of the flowable plastic mass onto the other side of the film or onto another substrate. The first and the second depositing device are aligned or may be aligned to one another so that surface coatings on both sides of the film are at least partly equal in overlapping. Preferably the device is used for producing a breathing active, water proof film which is coated on both sides.

The second depositing device comprises preferably at least one second depositing nozzle and a second movable screen. The second movable screen is arranged between the second depositing nozzle and the film or between the second depositing nozzle and the substrate. The second screen is movable synchronously to the first screen. Furthermore the first screen and the second screen are mutually alignable or aligned in the direction of the film and/or in a direction transversely to the running direction of the film. With the alignable arrangement of the first and of the second screen the partial surface coating may be deposited on the one side of the film equal in overlapping with the partial surface coating on the other side of the film. In this manner on both sides of the film in each case coated or in each case uncoated surface sections are produced. The breathing activity of the film coated on both sides is thus not compromised in comparison to the breathing activity of a film coated only on one side. Likewise the feel of a 3-ply laminate with a middle film according to the invention is considerably better than with a film with coatings, not equal in overlapping, of a film coated on both sides or comparable to the feel of a film coated only on one side. It is also conceivable to provide other depositing arrangements which permit a coating on both sides equal in overlapping. Instead of screens, e.g. gravure rollers may be used which serve the accommodation of the plastic material and which are mutually alignable.

In a particularly preferred embodiment example the first depositing device consists of a screen and the second depositing device functions according to the gravure principle. Typically on the one side there is provided a screen roller and on the other side an engraving roller. This arrangement is particularly advantageous with respect to the stability of the coating procedure. On account of the closed surface of the engraving roller this may serve well as a bearing roller. A further advantage with this arrangement lies in the fact that proceeding from the engraving roller as a pattern, in a simple manner a screen roller may be manufactured. By way of the fact that the screen roller is manufactured starting from the previously engraved engraving roller, it is ensured that the arrangement of the screen openings is arranged identically as the deepenings in the engraving roller. The engraving roller and the screen roller are mutually alignable in the previously described way and manner.

As a film these is typically applied a breathing-active, water-impermeable film, e.g. Goretex or Sympatex. Breathing-active and water-impermeable in this context means that the film lets through water vapour to a certain extent and that the film with normal use, e.g. as a piece of clothing, is waterproof.

In a preferred embodiment example of the invention the first and the second screen consist of screening drums which are rotatably mounted. The screening drums rotate in opposite directions.

However also a tape-like revolving screen is conceivable.

In a particularly preferred embodiment example the surface coating is directly dispensed from the screening drums onto the film. The film runs through between the two screening drums. With this the two screening drums are arranged such that their axes lie in a plane perpendicular to the film. The screening drum on the one side of the film thus simultaneously serves as a bearing roller for the other screening drum on the other side of the film.

Advantageously the screening drums are mutually alignable in the direction of the axis as well as in the direction of the running of the film. Furthermore also the axes of both the screening drums may be aligned such that they lie in one and the same plane.

The alignment of the screening drums in the running direction of the film may be achieved by a suitable selection of the rotational speed of the drums. In operation the rotational speed of the two screening drums is equally large so that the two screens move synchronously to one another. For aligning the one screen with respect to the other screen (in the circumferential direction or the direction of running) the movement speed may be selected differently for so long until the screens are aligned to one another. In this context aligned means that the screen openings of the one screen at the moment of the depositing of the partial surface coating run equal in overlapping with the screen openings of the other screen.

The screen openings form typically a dot grid. However also other arrangements, e.g. lines are conceivable.

In a particularly preferred further embodiment example the first and the second screen are designed identically. For example two identical screening drums may be applied. By way of the identical selection of the screen pattern it is ensured that a partial surface coating equal in overlapping may be produced on both surfaces of the film. It would however also be conceivable with one screen to provide less screen openings than with the other screen, so that the two screens are not completely identical.

In the case of screening drums it is particularly advantageous to drive these with a servo-motor. The servo-motor permits the alignment of the two screens in the running direction of the film.

The device comprises, arranged after the depositing devices in the running direction of the film, arrangements for the lamination of the film on both sides. Thereby a device for manufacturing sheet formations as a triple laminate is provided.

As a lamination for example tissue, woven material or fleeces are applied.

The method according to the invention, for depositing a partial surface coating on a film, is particularly advantageous when using a device as is described above. However other devices are also conceivable. According to the invention on both sides of the film a partial surface coating is deposited. The surface coatings on the two sides of the film are with this deposited aligned to one another in a manner such that the film has in each case on both sides coated and in each case on both sides uncoated sections. The partial surface coating on the one side of the film is thus at least partly equal in overlapping with the partial surface coating on the other side of the film.

The film according to the invention is advantageously manufactured with a device and with a method in the previously described form. However also other methods and devices for manufacturing such films would be conceivable. The film comprises on both sides a partial surface coating. According to the invention the surface coating of the first side is at least partly equal in overlapping to the surface coating of the second side. Thus on the film in each case on both sides coated and in each case on both sides uncoated sections are formed. At least partly equal in overlapping in this context is to be understood in that for each coated section on the first side of the film at the same location there is arranged a coated section on the second side of the film. It however also may be the case that on the second side yet additional coated sections are present. This may be advantageous when on the one side of the film more adhesive, for example more adhesive dots, are desired than on the other side of the film. It is also conceivable to form the dots on the one side of the film larger than the dots on the other side of the film.

The coating is with this preferably deposited dot-like onto the film. As a coating for example an adhesive of polyurethane is applied. Typically approx. 50 dots are deposited per $cm^2$ of film surface. The dots have a surface of 0.8 $mm^2$ per dot.

Figure 4:
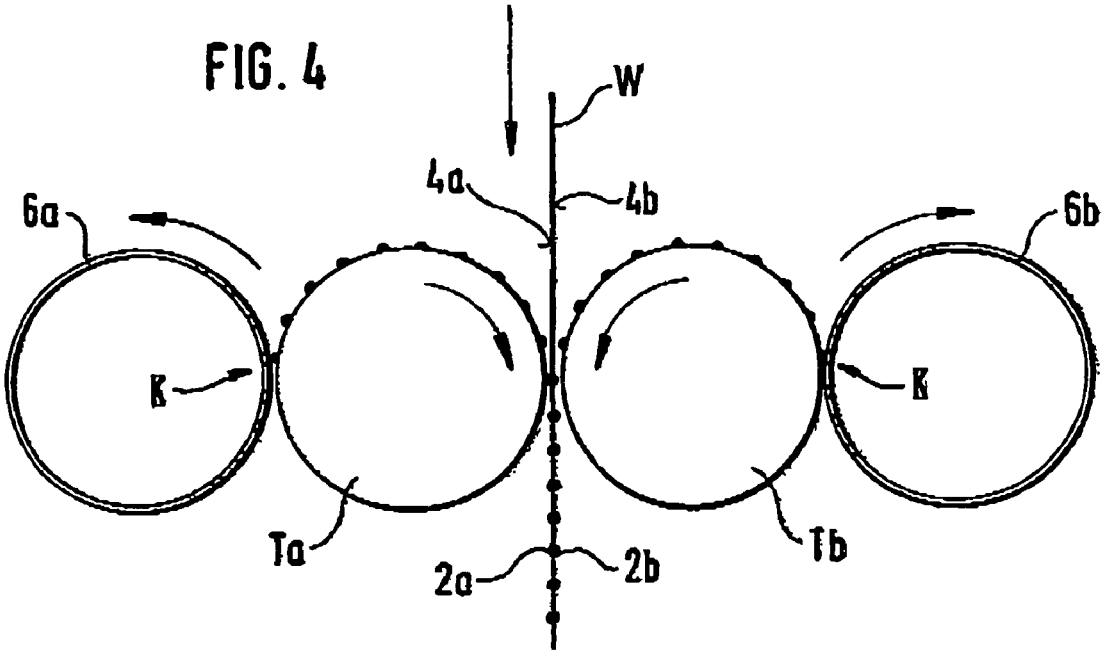
Figure 5:
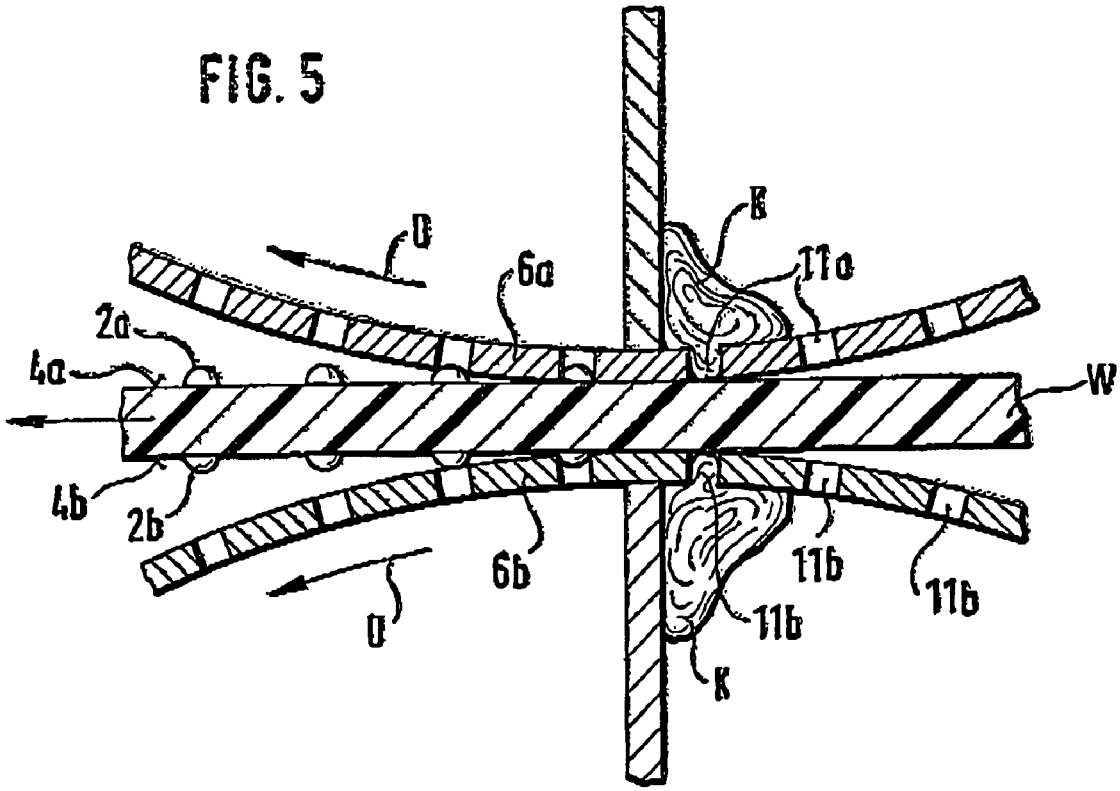
Figure 6:
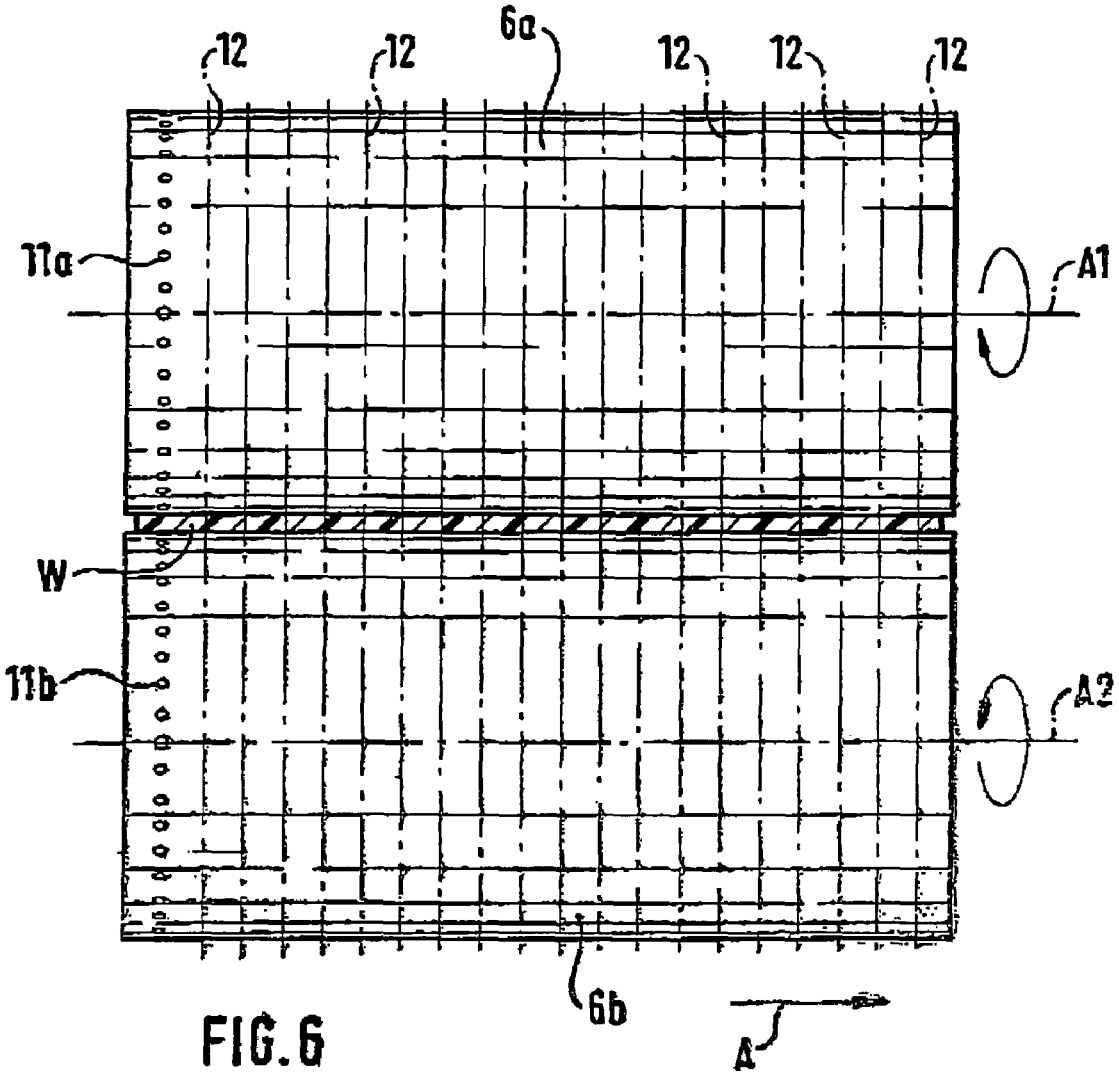
Figure 7:
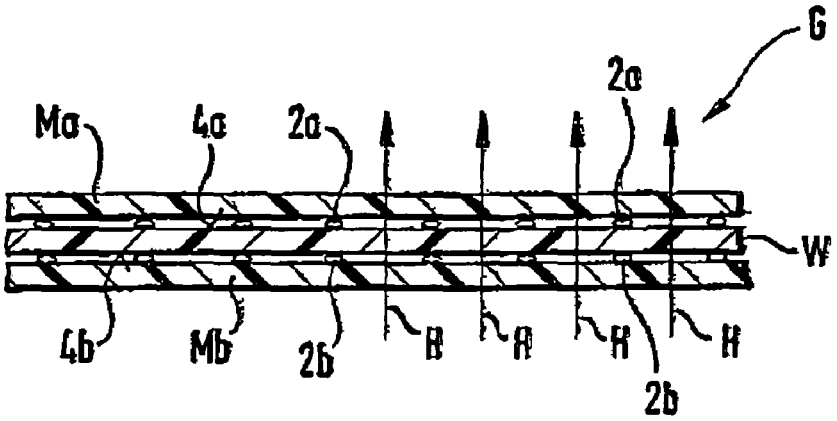
Figure 8:
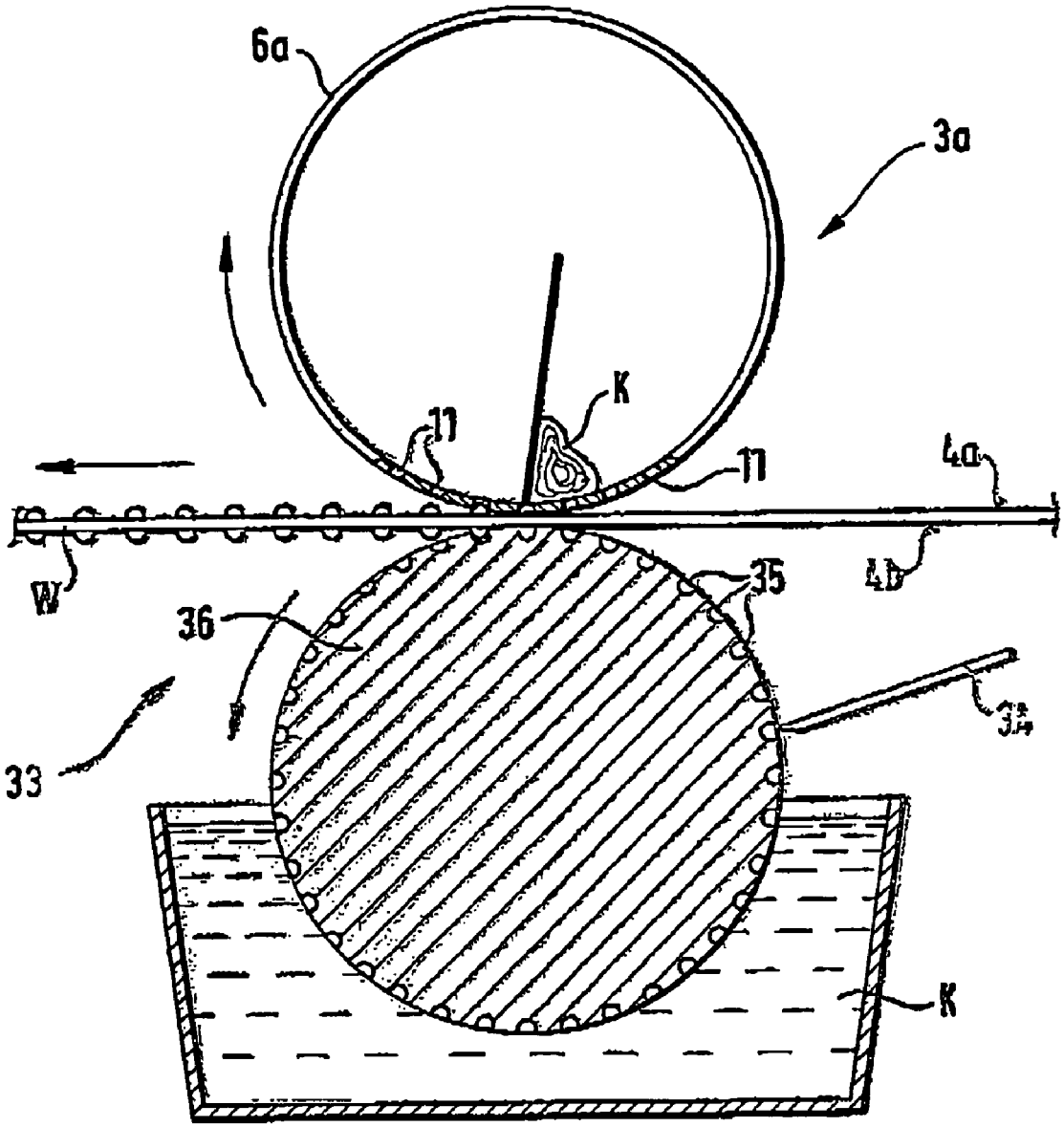

The invention is hereinafter explained in more detail in embodiment examples and by way of the drawings. There are shown:

FIG. 1 a schematic representation of the device according to the invention,

FIG. 2 an enlarged representation of the depositing device according to FIG. 1, FIGS. 3*a* to 3*c* various embodiment examples of the film according to the invention, FIG. 4 a schematic representation of an alternative embodiment example of depositing devices, FIG. 5 an enlarged representation of a cut-out of the depositing devices according to FIGS. 1 and 2, FIG. 6 a plan view of two depositing devices according to FIG. 1 or 2, FIG. 7 a schematic representation of a three-ply laminate according to the invention, and FIG. 8 an enlarged representation of a cut-out of an alternative embodiment example.

FIG. 1 shows a device 1 for the coating on both sides of a film W with a flowable plastic mass K.

The film W is led through in the running direction L about a deflection roller 8 and between two depositing devices 3*a*, 3*b*. The film is provided on both sides 4*a*, 4*b* with a coating 2*a*, 2*b*. Subsequently the film W is led via a stretcher bar 9 and supplied to a laminating arrangement 7.

The laminating arrangement 7 consists essentially of two calendars 10*a*, 10*b*. Via the calendars 10*a*, 10*b* from both sides of the film W there is supplied a material Ma and Mb for laminating the film W.

The flowable plastic mass K consists of an adhesive. The material Ma and Mb via the adhesive on both sides of the film W in the laminating arrangement is connected to the film W.

The film W consists of a breathing-active, waterproof film, for example Goretex or Sympatex. The materials Ma and Mb for the lamination are tissue, woven material or fleece, e.g. Polyester tissue or fleece.

After the lamination in the laminating arrangement 7 the film W is led as a three-ply laminate via a cooling table 14. The coatings 2*a*, 2*b* are as a partial surface coating deposited onto the sides 4*a*, 4*b* of the film W. Typically the partial surface coating is formed as a dot grid.

For depositing the dot-like surface coating both depositing devices 3*a*, 3*b* have a screening drum 6*a*, 6*b* rotatably mounted about an axis A1 and A2 respectively. The plastic material K from the inside of the screening drum is deposited through the screen openings 11*a*, 11*b* (see FIGS. 2 and 5) onto both surfaces 4*a*, 4*b* of the film W.

For depositing the plastic material K in the inside of the screen rollers 6*a*, 6*b* there is provided a depositing nozzle 5*a*, 5*b* and a doctor blade 23 on a doctor blade mounting 21. The doctor blade mounting 21 may be heated. On account of the rotational movement of the screen rollers 6*a*, 6*b* and of the angle of the doctor blade 23 the plastic material enters through the screen opening.

Around the screen rollers 6*a*, 6*b* there is furthermore provided an infrared cover 20 for heating the screen rollers 6*a*, 6*b*. The infrared cover 20 is necessary so that the plastic material K remains in the pasty condition so that the material may be deposited through the screen openings 11*a*, 11*b* in the screening drums 6*a*, 6*b* onto the surfaces 4*a*, 4*b* of the film W.

So that the surface coating 2*a*, 2*b* is equal in overlapping on both sides 4*a*, 4*b* of the film W, the screening drums are aligned to one another.

The axes A1, A2 of the two screening drums 6*a*, 6*b* lie in one and the same plane E which runs perpendicularly to the film W and perpendicularly to the running direction L of the film W. The axes A1, A2 may where appropriate be designed adjustable so that the lie exactly in the plane E.

The rotation speed of the screen rollers 6*a*, 6*b* is furthermore adjustable so that the screen rollers 6*a*, 6*b* rotate synchronously to one another and synchronously to the film W. The surface speed of the screening drums 6*a*, 6*b* corresponds to the speed with which the film W is moved forwards.

The screening drums 6*a*, 6*b* are furthermore aligned in the axis direction A1, A2 and in the circumferential direction U1 and U2 so that the screen openings 11*a*, 11*b* in the two screening drums 6*a*, 6*b* are flush with one another. The plastic material K is liquified in the inside of the screening drum 6*a*, 6*b* and deposited through the screen openings 11*a*, 11*b* onto the surfaces 4*a*, 4*b* of the film W was partial surface coatings 2*a*, 2*b*.

In FIGS. 3*a* to 3*c* there are shown various embodiment forms of film W coated according to the invention.

According to FIG. 3*a* for each coated surface region 2*a* on the one side 4*a* of the film W on the other side 4*b* at the same location there is formed an equally large coated surface region 2*b*. The pattern of the coating 2*a* on the one surface 4*a* is thus equal in overlapping with the pattern of the coating 2*b* on the other side 4*b* of the film W.

In FIG. 3*b* there is shown a film W with which for each coated region 2*b* on the one side 4*b*, on the other side 4*a* there is formed a surface region 2*a*. On the side 4*a* there are furthermore formed yet further surface regions 2*a*.

In FIG. 3*c* there is shown a film W with which to each dot 2*a* on the one side 4*a* there corresponds a dot 2*b* on the other side 4*b*. The size of the dots 2*a* and 2*b* is however different.

With the term essentially equal in overlapping in the following application each of the embodiment examples 3*a* to 3*c* are included.

In FIG. 4 there is shown an alternative embodiment of the device according to the invention. Instead of the fact that as according to FIG. 1 the partial surface coating 2*a*, 2*b* is directly deposited from a screening drum 6*a*, 6*b* onto the film W, in FIG. 4 there is provided a substrate Ta, Tb. The plastic material K in a dot grid is added onto the surface of the substrate Ta, Tb and from this is deposited onto the film W. The substrates Ta, Tb are designed as rollers. The rotational speed of the screening drums 6*a*, 6*b* and of the rollers Ta, Tb are synchronous to one another and synchronous to the speed of the film W. In that the screening drums 6*a*, 6*b* are aligned to one another, there is effected an indirect deposition of partial surface coatings which are aligned to one another, i.e. are essentially equal in overlapping on both sides 4*a*, 4*b*.

Of course instead of a substrate Ta, Tb in the form of a roller also a tape-like substrate as described in CH 648 497 or CH 663 310 may be applied.

In FIG. 5 there is shown an enlarged representation of the screening drums 6*a*, 6*b* according to FIG. 2 in the region of the deposition of the elastic material K onto the film W. The screen openings 11*a*, 11*b* of the screening drums 6*a*, 6*b* are flush with one another in this region. The plastic material K is thus deposited equal in overlapping on the upper side 4*a* and on the lower side 4*b*.

For adjusting the circumferential speed of the screening drums 6*a*, 6*b* a motor is driven correspondingly quickly. For aligning the screen openings 11*a*, 11*b* in the circumferential direction U1, U2 the one screening drum 6*a* is moved faster than the other screening drum 6*b* for so long until the screen openings 11*a*, 11*b* are flush with one another. Thereafter the screening drums are rotated further with the same circumferential speed. The alignment may be effected visually (i.e. by observation of an operating person). The screening drums may for this be also provided with reference markings on their surface. It is also conceivable to provide reference markings which are automatically detectable (e.g. via optical electronics).

In FIG. 6 there is shown schematically a plan view of the two screening drums 6*a*, 6*b*. The screening drums 6*a*, 6*b* are mounted rotatably about axes A1, A2. On the left edge of the screening drum 6*a*, 6*b* schematically there are shown screen openings 11*a*, 11*b*. The screen openings 11*a* of the one drum 6*a* are aligned with respect to the screen openings 11*a* of the other screening drum 6*b* and lie in one and the same plane running perpendicularly to the axis A Subsequent to the represented screen openings 11*a*, 11*b* there follow further (not shown) screen openings 11*a*, 11*b* which are arranged in planes 12 running perpendicularly to the axes A1, A2.

The screening drums 6*a*, 6*b* are designed identically. In particular on both screening drums 6*a*, 6*b* there are arranged an equal number of screen openings 11*a*, 11*b* with equal distances.

So that the screen openings 11*a* of the one screening drum 6*a* lie in the same plane 12 as the screen openings 11*b* of the other screening drum 6*b* the screening drums 6*a*, 6*b* are displaceable along the axes A1, A2. The displacement may be effected manually or motorically.

In FIG. 7 there is shown a sheet formation G according to the invention which is designed as a three-ply laminate. The film w according to the invention forms a middle layer. On the one side 4*a* of the film W there is laminated a first material Ma. On the second side 4*b* of the film W there is laminated a second material Mb. The material Ma, Mb consists of a tissue, a woven material or a fleece which via the partial surface coating 2*a*, 2*b* in the form of dots is connected to the film W formed of a film material. Because the surface coatings 2*a*, 2*b* on the surfaces 4*a*, 4*b* are aligned to one another, moisture H may pass unhindered through intermediate spaces between the surface coatings 2*a* and 2*b*.

In FIG. 8 there is shown an enlarged cut-out of a film running through between two deposition mechanisms of an alternative embodiment example. The first depositing mechanism 3*a* is designed in the previously described form and consists essentially of a screening drum 6*a* by way of which the plastic mass K may be deposited onto the side 4*a* of the film W.

In contrast to the previously described embodiment examples the second depositing device 33 is designed with an engraving roller 36. The engraving roller 36 comprises deepenings 35 which are distributed with the same pattern over the surface of the engraving roller 36 as the screen openings 11 of the screening drum 6*a*.

The engraving roller 36 is led through a bath which contains the plastic material K. With a doctor blade 34 the plastic material is doctored from the surface of the engraving roller so that the plastic material K only still remains in the deepenings 35. From the deepenings 35 the plastic material by contact is deposited onto the surface 4*b* of the film W.

In contrast to screen openings 11 the deepenings 35 form a clearly defined counter bearing surface for the screening drum 6*a*. A stable operation is possible therewith.

The invention claimed is:

1. An air-permeable, water impermeable structure comprising an air-permeable water impermeable substrate having a first surface and a second surface opposite the first surface, a first adhesive surface coating deposited in a discontinuous pattern on the first surface of the substrate and a second adhesive surface coating deposited in a discontinuous pattern on the second surface of the substrate wherein the discontinuous adhesive surface coating pattern of the first surface of the substrate is at least partially aligned with the discontinuous adhesive surface coating pattern of the second surface, so that the substrate has areas which are coated on both surfaces and areas which are uncoated on both surfaces.

2. A substrate according to claim 1, wherein the surface coatings include adhesive dots.

3. An air permeable, water impermeable structure according to claim 1, wherein the adhesive surface coating of the first surface of the substrate is only partially aligned with the adhesive surface coating of the second surface.

4. A sheet formation containing an air permeable, water impermeable substrate having a first surface and a second surface opposite the first surface, a first sheet of a material laminated to the first surface of the substrate by a first adhesive coating on the first surface of the substrate, and a second sheet of a material laminated to the second surface of the substrate by a second adhesive coating on said second surface of the substrate, wherein both the first and second adhesive surface coatings are deposited in discontinuous patterns on both the first and second surfaces of the substrate, and the adhesive surface coating pattern of the first surface of the substrate is at least partially aligned with the adhesive surface coating pattern of the second surface of the substrate, so that the substrate has areas which are coated on both the first and second surfaces and areas which are uncoated on both the first and second surfaces.

5. A sheet formation according to claim 4, wherein the adhesive surface coating of the first surface of the substrate is only partially aligned with the adhesive surface coating of the second surface.

* * * * *